US009027264B2

(12) United States Patent
Ouellette

(10) Patent No.: US 9,027,264 B2
(45) Date of Patent: May 12, 2015

(54) DITCH DIGGER

(71) Applicant: Andre Ouellette, Lachute (CA)

(72) Inventor: Andre Ouellette, Lachute (CA)

( * ) Notice: Subject to any disclaimer, the term of this patent is extended or adjusted under 35 U.S.C. 154(b) by 286 days.

(21) Appl. No.: 13/650,741

(22) Filed: Oct. 12, 2012

(65) Prior Publication Data

US 2013/0091744 A1 Apr. 18, 2013

Related U.S. Application Data

(60) Provisional application No. 61/546,448, filed on Oct. 12, 2011.

(51) Int. Cl.

| | |
|---|---|
| ***E02D 17/06*** | (2006.01) |
| ***E02F 5/02*** | (2006.01) |
| ***E02F 5/14*** | (2006.01) |
| ***E02F 7/02*** | (2006.01) |

(52) U.S. Cl.

CPC ..... *E02F 5/022* (2013.01); *E02F 5/025* (2013.01); *E02F 5/027* (2013.01); *E02F 5/14* (2013.01); *E02F 5/145* (2013.01); *E02F 7/02* (2013.01)

(58) Field of Classification Search

CPC ..... E02F 5/025; E02F 3/7695
USPC ..... 37/347, 372, 373, 379, 411, 142.5, 901, 37/426, 424

See application file for complete search history.

(56) References Cited

U.S. PATENT DOCUMENTS

| | | | | |
|---|---|---|---|---|
| 32,772 | A | | 7/1861 | Ives |
| 286,696 | A | | 10/1883 | Hanson |
| 328,407 | A | | 10/1885 | Humphreys |
| 647,198 | A | | 4/1900 | Rasmussen |
| 876,834 | A | | 1/1908 | Pettit |
| 1,134,226 | A | | 4/1915 | Redding |
| 1,391,765 | A | | 9/1921 | Donaldson |
| 1,495,704 | A | * | 5/1924 | Mahlstadt ..... 37/347 |
| 1,497,505 | A | * | 6/1924 | Guy et al. ..... 37/411 |
| 2,284,412 | A | * | 5/1942 | Frentzel, Jr. et al. ..... 37/424 |
| 2,682,716 | A | * | 7/1954 | Burkholder ..... 37/142.5 |
| 2,755,573 | A | * | 7/1956 | Bannister ..... 37/142.5 |
| 3,314,175 | A | * | 4/1967 | Petty et al. ..... 37/386 |
| 3,417,495 | A | | 12/1968 | Barras |
| 3,419,975 | A | | 1/1969 | MacDonald |
| 3,474,548 | A | * | 10/1969 | Miller ..... 37/426 |
| 3,624,826 | A | | 11/1971 | Rogers |
| 3,714,990 | A | | 2/1973 | Tomik |
| 3,738,028 | A | * | 6/1973 | Reinhardt ..... 37/416 |
| 3,992,791 | A | * | 11/1976 | Dean ..... 37/395 |
| 4,161,072 | A | | 7/1979 | Pronovost |
| 4,247,997 | A | | 2/1981 | Paurat et al. |
| 4,969,279 | A | | 11/1990 | Mantingh |
| 5,511,326 | A | | 4/1996 | Liebrecht, Jr. |
| 6,299,381 | B1 | | 10/2001 | Liebrecht, Jr. |

* cited by examiner

*Primary Examiner* — Thomas B Will
*Assistant Examiner* — Joan D Misa

(57) ABSTRACT

A ditch digger for removing earth from the ground to dig a ditch, the ditch digger comprising: a body; a substantially elongated blade mounted to the body, the blade defining a blade front end and a substantially longitudinally opposed blade rear end, the blade defining a blade bottom section and a pair of laterally opposed blade side sections extending generally upwardly therefrom. When the ditch digger is in an operational configuration, the blade bottom section is lower adjacent the blade front end than adjacent the blade rear end. Moving the ditch digger along the ground with the blade front end inserted in the ground and the blade rear end provided above the ground removes the earth from the ground to dig the ditch.

17 Claims, 3 Drawing Sheets

DITCH DIGGER

FIELD OF THE INVENTION

The present invention relates generally to the field of digging. More specifically, the present invention is concerned with a ditch digger.

BACKGROUND OF THE INVENTION

Ditch digging is often a time-consuming operation performed using an excavator. There are dedicated ditch diggers, but many of them are relatively complex and therefore relatively expensive to manufacture and maintain. Some ditch diggers remove earth from the ground while being simply pushed or pulled by a vehicle at an angle with the ground. However, this type of ditch digger runs the risk that it becomes clogged with the earth that has been removed from the ground.

Against this background, there exists a need in the industry to provide an improved ditch digger.

An object of the present invention is therefore to provide an improved ditch digger.

SUMMARY OF THE INVENTION

In a broad aspect, the invention provides a ditch digger for removing earth from the ground to dig a ditch, the ditch digger comprising: a body; a substantially elongated blade mounted to the body, the blade defining a blade front end and a substantially longitudinally opposed blade rear end, the blade defining a blade bottom section and a pair of laterally opposed blade side sections extending generally upwardly therefrom. When the ditch digger is in an operational configuration, the blade bottom section is lower adjacent the blade front end than adjacent the blade rear end. Moving the ditch digger along the ground with the blade front end inserted in the ground and the blade rear end provided above the ground removes the earth from the ground to dig the ditch.

In a variant, the ditch digger further comprises a blade cleaner for moving the earth along the blade. In some embodiments of the invention, the blade cleaner includes a cleaning element operatively coupled to the body so that at least part of the cleaning element is movable substantially longitudinally relative to the blade, the cleaning element defining a cleaning element upper end and a cleaning element lower end opposed thereto, the cleaning element being movable between an extended configuration and a retracted configuration, the cleaning element lower end being closer to the blade bottom section in the extended configuration than in the retracted configuration; a cleaning element longitudinal actuator operatively coupled to the cleaning element for moving the at least part of the cleaning element longitudinally along the blade; and a cleaning element transversal actuator operatively coupled to the cleaning element for moving the cleaning element between the retracted and extended configurations.

In some embodiments of the invention, the cleaning element longitudinal and transversal actuators are operatively coupled to each other such that when the cleaning element moves in a frontward direction leading from the blade rear end towards the blade front end, the cleaning element is in the retracted configuration; and when the cleaning element moves in a rearward direction leading from the blade front end towards the blade rear end, the cleaning element is in the extended configuration.

In some embodiments of the invention, the cleaning element includes a fork-shaped member extending generally vertically. In some embodiments of the invention, a cleaning element support is provided above the blade, the cleaning element being pivotally mounted to the cleaning element support such that the cleaning element lower end moves substantially longitudinally relative to the blade when the cleaning element is pivoted relative to the cleaning element support.

In some embodiments of the invention, the cleaning element transversal actuator is operable to selectively move in a reciprocating movement the cleaning element independently from the cleaning element longitudinal actuator.

In some embodiments of the invention, the ditch digger further comprises a support wheel mounted to the body to support the body on the ground.

In a variant, a blade depth control wheel is mounted to the body substantially adjacent and substantially above the blade front end. In some embodiments of the invention, the blade depth control wheel is mounted to the body so as to be movable relative to the blade bottom section to selectively vary a vertical distance between the blade depth control wheel and the blade bottom section. In some embodiments of the invention, a blade depth control wheel actuator is provided for rotating the blade depth control wheel to assist in moving the ditch digger along the ground. In some embodiments of the invention, the blade depth control wheel and cleaning element longitudinal actuators are operatively coupled to each other such that a wheel speed of the depth control wheel relative to the ground is substantially similar to a cleaning element rearward speed of the cleaning element lower end relative to the blade bottom section.

In a variant, a conveyor is provided adjacent the blade rear end for conveying the earth away from the blade, the conveyor extending in a direction leading away from the blade.

In some embodiments of the invention, the blade has a substantially arcuate transversal cross-sectional configuration. For example, the blade is substantially hemi-cylindrical.

In a variant, the body includes a body first element attachable to a vehicle, a body second element supporting the blade and a linking arm extending between the body first and second elements. In some embodiments of the invention, the linking arm is pivotally mounted to both the body first and second elements. In some embodiments of the invention, the body second element is laterally offset relative to the body first element. In some embodiments of the invention, a linking arm actuator is operatively coupled to at least one of the body first and second elements and to the linking arm for selectively adjusting an angle between the at least one of the body first and second elements and the linking arm.

Advantageously, the proposed ditch digger is relatively simple to manufacture and maintain and can consequently be relatively inexpensive to buy and maintain. The proposed ditch digger is also able to dig ditches relatively rapidly in many different types of grounds.

Other objects, advantages and features of the present invention will become more apparent upon reading of the following non-restrictive description of preferred embodiments thereof, given by way of example only with reference to the accompanying drawings.

DETAILED DESCRIPTION

Figure 4:
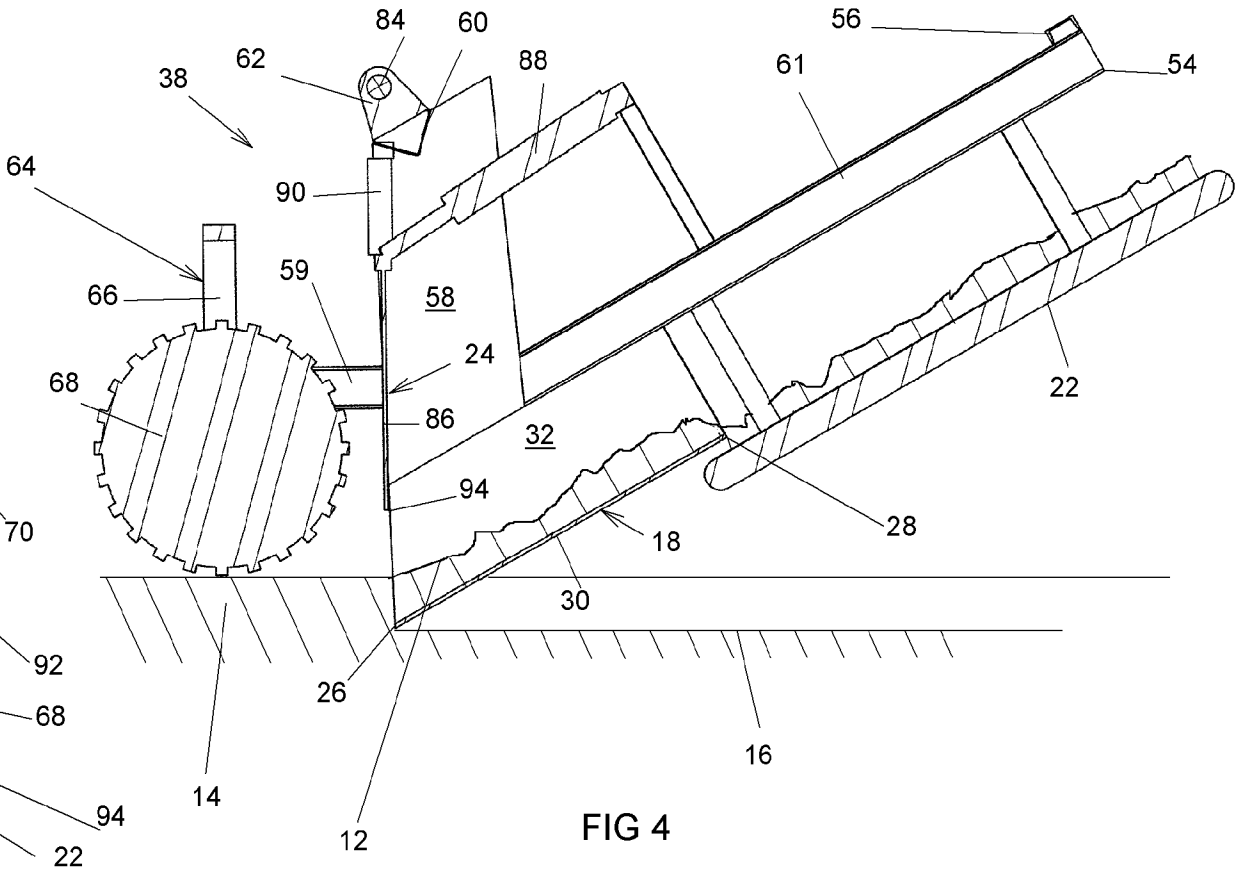
FIG. 4, in an environmental side cross-sectional view taken along section line A-A of FIG. 3, illustrates the body second element, blade, cleaning element and blade depth control wheel shown in FIG. 3, the cleaning element being shown in a retracted configuration and a frontwardmost position, the blade depth control wheel being shown in a raised position.
Figure 3:
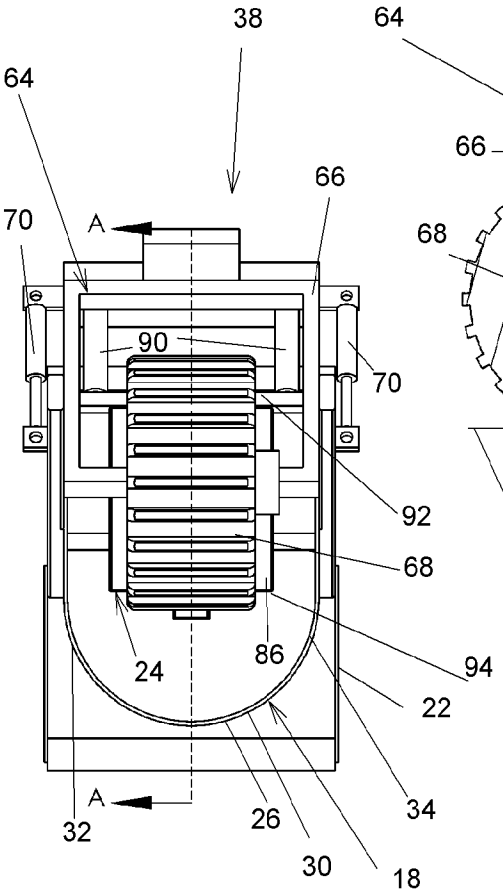
FIG. 3, in a view intermediate a front elevation view and a top plan view, illustrates a body second element, a blade, a cleaning element and a blade depth control wheel, all part of the ditch digger shown in FIGS. 1 and 2.

With reference to FIGS. 1 to 5, there is shown a ditch digger 10 in accordance with an embodiment of the present invention. As seen in FIG. 4, the ditch digger 10 is usable for removing earth 12 from the ground 14 to dig a ditch 16. The ditch digger 10 is towable by a vehicle (not shown in the drawings), but ditch diggers 10 that move under their own power are also within the scope of the claimed invention. While the ditch digger 10 is described as being used for digging a ditch 16, similar devices are usable to dig any other types of elongated relatively shallow depressions in the ground 14, such as irrigation channels and depressions used to receive pipes and cables which are afterwards filled back with earth 12. Therefore, the term "ditch" 16 should be construed broadly as any elongated channel dug in the ground 14.

This document uses directional terminology, such as front, rear, lower, and upper, among others. This terminology refers to the orientation of the ditch digger 10 when in an operational configuration digging the ditch 16 on relatively horizontal ground 14. This terminology is used for clarity reasons and should not be used to restrict the scope of the present invention. Also, the terminology "substantially" is used to denote variations in the thus qualified terms that have no significant effect on the principle of operation of the ditch digger 10. These variations may be minor variations in design or variations due to mechanical tolerances in manufacturing and use of the ditch digger 10. These variations are to be seen with the eye of the reader skilled in the art.

The ditch digger 10 typically includes many actuators that may be electrically or hydraulically powered. Electrical wires, batteries, motors and hydraulic lines are not illustrated in the drawings for clarity reasons. However, such components are to be included in physical embodiments of the ditch digger 10 so as to perform the functions of the various actuators. In addition, the ditch digger 10 may include a controller 100 for controlling the functions performed by the actuators. This controller 100 is linked through links, such as electrical wires and/or hydraulic lines, among other possibilities, the latter not being shown in the drawings. This controller 100 can be purely mechanical, for example hydraulic, or can use electronic components. Such controllers 100 are known in the art and will not be described in details herein. Also, hydraulic, mechanical or electrical power can be provided to the ditch digger 10 by the vehicle using conventional power providing elements, or the ditch digger 10 can include its own power source.

Figures 1, 2:
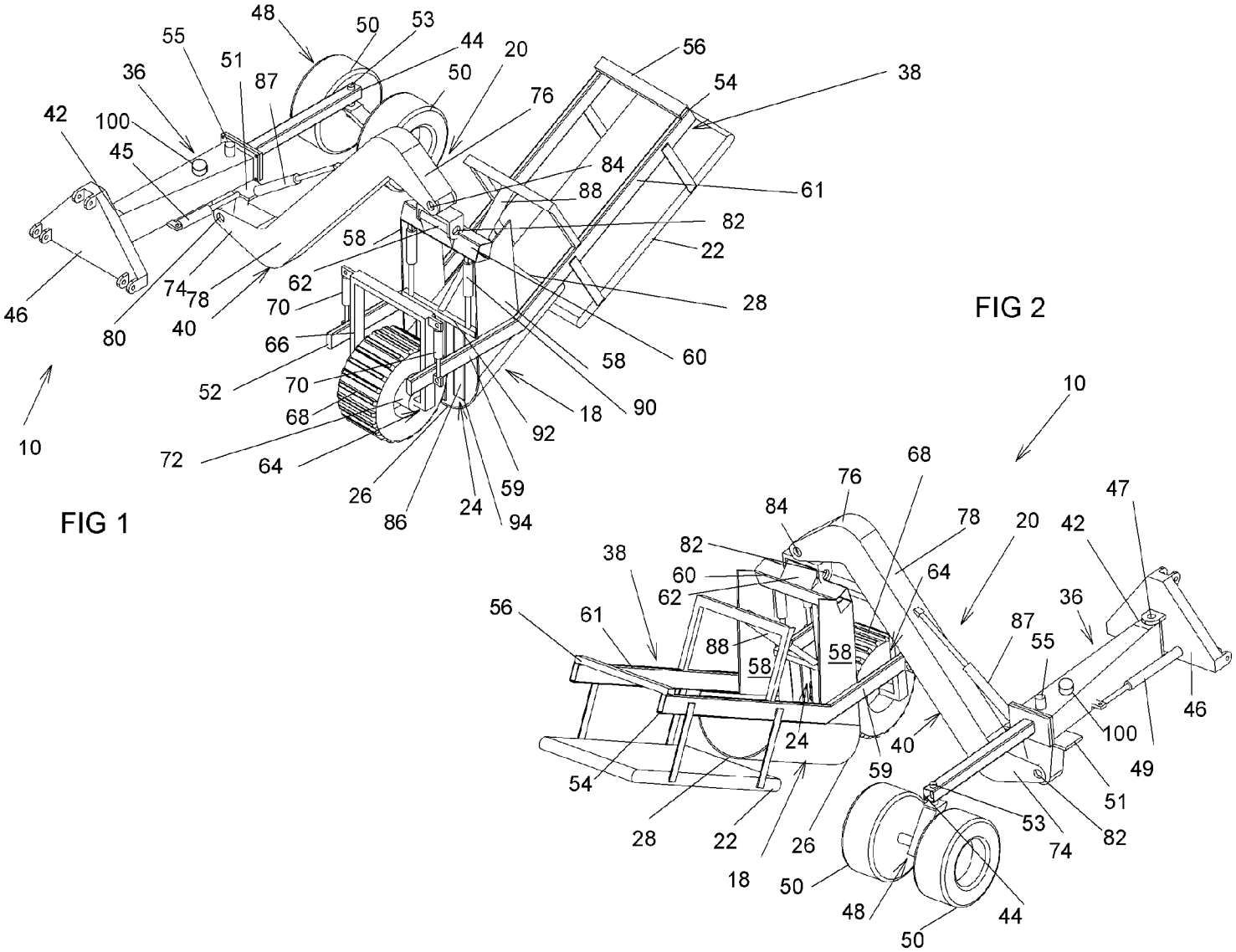
FIG. 1, in a perspective view, illustrates a ditch digger in accordance with an embodiment of the present invention.
FIG. 2, in an alternative perspective view, illustrates the ditch digger shown in FIG. 1.

As seen for example in FIGS. 1 and 2, the ditch digger 10 includes a substantially elongated blade 18 mounted to a body 20. In some embodiments of the invention, the ditch digger 10 includes a conveyor 22. In some embodiments of the invention, the ditch digger 10 also includes a blade cleaner 24 for moving the earth 12 along the blade 18.

Figure 5:
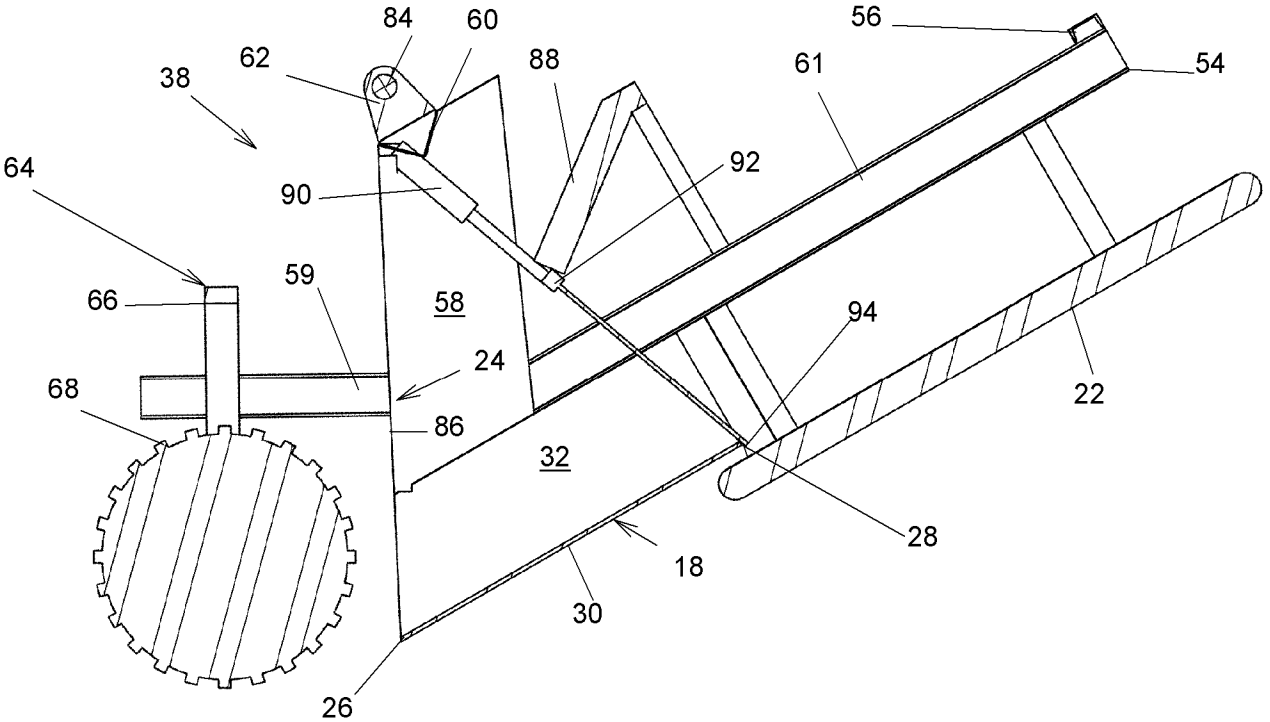
FIG. 5, in a side cross-sectional view taken along section line A-A of FIG. 3, illustrates the body second element, blade, cleaning element and blade depth control wheel shown in FIGS. 3 and 4, the cleaning element being shown in an extended configuration and a rearwardmost position, the blade depth control wheel being shown in a lowered position.

Referring to FIGS. 4 and 5, the blade 18 defines a blade front end 26 and a substantially longitudinally opposed blade rear end 28. The blade 18 also defines a blade bottom section 30 and a pair of laterally opposed blade side sections 32 and 34 (better seen in FIG. 3) extending generally upwardly therefrom. In some embodiments of the invention, the blade bottom and side sections 30, 32 and 34 extend continuously from each other without a distinct demarcation therebetween. For example, in these embodiments, the blade 18 has a substantially arcuate transversal cross-sectional configuration. In a very specific embodiment of the invention, the blade 18 is substantially hemi-cylindrical. This shape is particularly advantageous as it allows digging of conventionally shaped ditch 16 relatively easily. Also, such blades 18 are relatively easily manufactured. However, blades 18 having any other suitable shape are within the scope of the invention.

When the ditch digger 10 is in an operational configuration, the blade bottom section 30 is lower adjacent the blade front end 26 than adjacent the blade rear end 28. Moving the ditch digger 10 along the ground 14 with the blade front end 26 inserted in the ground 14 and the blade rear end 28 provided above the ground 14 removes the earth 12 from the ground 14 to dig the ditch 16.

In some embodiments of the invention, as seen in FIGS. 1 and 2, the body 20 includes a body first element 36 attachable to a vehicle (not shown in the drawings), a body second element 38 supporting the blade 18 and a linking arm 40 extending between the body first and second elements 36 and 38. Typically, the linking arm 40 is pivotally mounted to both the body first and second elements 36 and 38 and the body second element 38 is laterally offset relative to the body first element 36.

The body first element 36 is substantially elongated and defines a first element front end 42 and a substantially opposed first element rear end 44. An attachment 46 is provided substantially adjacent the first element front end 42 for attaching the body first element 36 to a vehicle (no shown in the drawings). For example, the attachment 46 is attachable to a conventional farm tractor, among other possibilities. In some embodiments of the invention, the attachment 46 is pivotally mounted to the body first element 36 so as to pivot about a vertical pivot 47 (seen only in FIG. 2). In these embodiments, it is typical to have an attachment actuator 49 to pivot the attachment 46 to selected angles. For example, the attachment actuator 49 includes an hydraulic cylinder pivotally mounted at the ends thereof to the body first element 36 and to the attachment 46, eccentrically relative to the vertical pivot 47.

A support wheel assembly 48 including one or more support wheels 50 is mounted to the body first element 36, typically adjacent the first element rear end 44, to support the body 20 on the ground 14. The support wheels 50 are typically freely rotatable. Also, a first element linking arm attachment 51 is mounted to the body first element 36 at a position intermediate the first element front and rear ends 44. In some embodiments of the invention, the support wheel assembly 48 and the first element linking arm attachment 51 are both pivotally mounted to the body first element 36 so as to be respectively pivotable about substantially vertical support wheel assembly and first element linking arm pivots 53 and 55. In some embodiments of the invention, a first element linking arm attachment actuator 45 controls the pivotal movement of the first element linking arm attachment 51 about the first element linking arm pivot 55. For example, the first element linking arm attachment actuator 45 is an hydraulic cylinder pivotally mounted at opposed ends thereof to the body first element 36 and to the first element linking arm attachment 51, eccentrically relative to the first element linking arm pivot 55.

Referring to FIG. 1 for example, the body second element 38 is also substantially elongated and defines a second element front end 52 and a substantially opposed second element rear end 54. The body second element 38 includes a second element frame 56 having generally U-shaped configuration. The second element frame 56 includes second element frame front and rear sections 59 and 61 that are angled relative to each other so that the second element frame 56, when seen from the side, is substantially hockey-stick shaped. A pair of laterally opposed blade mounts 58 are secured to the second element frame 56 and the blade 18 is mounted to the blade mounts 58, below the second element frame 56. A cross-member 60 extends laterally between the blade mounts 58 opposed to the blade 18. A second element linking arm attachment 62 extends from the cross-member 60. While a specific shape of the body second element 38 is shown in the drawings, other shapes are also possible.

A blade depth control assembly 64, better seen in FIG. 1, is mounted to the body second element 38 substantially adjacent and substantially above the blade front end 26, typically adjacent the second element front end 52. The blade depth control assembly 64 includes a blade depth control assembly frame 66 to which a blade depth control wheel 68 is rotatably mounted so as to be rotatable about a transversal axis. A frame position adjuster is provided for selectively adjusting a vertical position of the blade depth control assembly frame 66 relative to the blade 18. For example, the frame position adjuster includes a pair of laterally opposed hydraulic cylinders 70 each extending between the blade depth control assembly frame 66 and the second element frame 56. The blade depth control wheel 68 is therefore mounted to the body 20, and more particularly to the body second element 38, so as to be movable relative to the blade bottom section 30 to selectively vary a vertical distance between the blade depth control wheel 68 and the blade bottom section 30.

In some embodiments of the invention, a blade depth control wheel actuator 72, for example an electrical or hydraulic motor, is provided for rotating the blade depth control wheel 68 to assist in moving the ditch digger 10 along the ground 14.

The linking arm 40 has any suitable shape. For example, linking arm 40 includes relatively short arm first and second end sections 74 and 76 and a relatively longer arm intermediate section 78 extending therebetween. The arm first and second end sections 74 and 76 are angled relative to the arm intermediate section 78. The arm first end section 74 is pivotally mounted to the first element linking arm attachment 51 so as to pivot about a generally longitudinally and horizontally oriented first linking pivot 80. The arm second end section 76 is pivotally mounted to the second element linking arm attachment 62 so as to pivot about a second linking pivot 82 and about a third linking pivot 84. The second linking pivot 82 is generally transversally and horizontally oriented and the third linking pivot 84 is generally longitudinally and horizontally oriented. However, other orientations of the first, second, and third linking pivots 80, 82 and 84 are possible.

In some embodiments of the invention, a linking arm actuator 87, for example an hydraulic cylinder, is operatively coupled to at least one of the body first and second elements 36 and 38 and to the linking arm 40 for selectively adjusting an angle between the at least one of the body first and second elements 36 and 38 and the linking arm 40. For example, the linking arm actuator 87 is pivotally attached at the ends thereof to the arm intermediate section 78 and to the body first element 36.

The conveyor 22 is provided substantially adjacent the blade rear end 28 and extends in a direction leading away from the blade 18. The conveyor 22 receives the earth 12 from the blade 18 and carries the earth 12 away from the blade 18. The conveyor 22 is any suitable conventional conveyor 22, for example of the type including a belt mounted to a series of parallel rollers, at least some of which are powered to move the belt therealong. In some embodiments of the invention, the conveyor 22 is suspended from the second element frame 56 by using suitable conveyor supporting brackets. However, the conveyor 22 is mountable to the second element frame 56 in any other suitable manner. The conveyor 22 may move the earth 12 to another conveyor (not shown in the drawings) oriented at an angle relative to the blade 18, or to an earth receiving container (not shown in the drawings). In both instances, the objective is to move the earth 12 removed from the ground 14 away from the blade 18 and the ditch 16.

The blade cleaner 24 includes a cleaning element 86, a cleaning element longitudinal actuator 88 and a cleaning element transversal actuator 90. The cleaning element 86 is operatively coupled to the body 20 so that at least part thereof is movable substantially longitudinally relative to the blade 18. The cleaning element 86 defines a cleaning element upper end 92 and a cleaning element lower end 94 opposed thereto. In the embodiment of the invention shown in the drawings, the cleaning element lower end 94 moves longitudinally along to the blade bottom section 30. The cleaning element 86 is movable between a frontwardmost position, shown in FIG. 4, and a rearwardmost position, shown in FIG. 5. Typically, in the frontwardmost position, the cleaning element lower end 94 is adjacent the blade front end 26 and in the rearwardmost position, the cleaning element lower end 94 is adjacent the blade rear end 28.

The cleaning element 86 is movable between an extended configuration, shown in FIG. 5, and a retracted configuration, shown in FIG. 4. The cleaning element lower end 94 is closer to the blade bottom section 30 in the extended configuration than in the retracted configuration. In a specific embodiment of the invention, the cleaning element 86 includes a fork-shaped member extending generally perpendicularly or at an angle relative to the blade 18. However, other types and shapes of cleaning elements 86 are within the scope of the present invention.

The cleaning element longitudinal actuator 88 is operatively coupled to the cleaning element 86 for moving at least part of the cleaning element 86 longitudinally along the blade 18. For example, the cross-member 60 is a cleaning element support provided above the blade 18 and the cleaning element 86 is pivotally mounted to the cross-member 60 such that the cleaning element lower end 94 moves substantially longitudinally relative to the blade 18 when the cleaning element 86 is pivoted relative to the cross-member 60. Also, the cleaning element longitudinal actuator 88 takes the form of an hydraulic cylinder pivotally mounted at the ends thereof to the cleaning element 86 and to the second element frame 56. In some embodiments of the invention, the cleaning element transversal actuator 90 is operable for selectively fixedly positioning the cleaning element 86 in the retracted configuration so that the blade cleaner 24 is not used at that time when operating the ditch digger 10.

The cleaning element transversal actuator 90 is operatively coupled to the cleaning element 86 for moving the cleaning element 86 between the retracted and extended configurations. For example, the cleaning element transversal actuator 90 moves the cleaning element 86 towards and away from the cross-member 60. In some embodiments of the invention, the cleaning element transversal actuator 90 includes one or more hydraulic cylinders extending between the cross-member 60 and a cleaning element 86. however, in alternative embodiments of the invention, the cleaning element transversal actuator 90 pivots the cleaning element 86 to move the cleaning element 86 between the extended and retracted configurations.

Typically, the cleaning element longitudinal and transversal actuators 88 and 90 are operatively coupled to each other such that when the cleaning element 86 moves in a frontward direction leading from the blade rear end 28 towards the blade front end 26, the cleaning element 86 is in the retracted configuration, and, when the cleaning element 86 moves in a rearward direction leading from the blade front end 26 towards the blade rear end 28, the cleaning element 86 is in the extended configuration. This coupling is either perform hydraulically or using electronics to control valves controlling the flow of an hydraulic fluid in the ditch digger 10, among other possibilities.

In some embodiments of the invention, the blade depth control wheel and cleaning element longitudinal actuators 72 and 88 are operatively coupled to each other such that a wheel speed of the blade depth control wheel 68 relative to the ground 14 is substantially similar to, or in some embodiments larger than, a cleaning element rearward speed of the cleaning element lower end 94 relative to the blade bottom section 30. To that effect, the cleaning element longitudinal actuator 88 and the blade depth control wheel actuator 72 may be linked, mechanically, electrically, optically or through radio waves, for example, to the vehicle to which the ditch digger 10 is attached such that the cleaning element longitudinal actuator 88 is moved along the blade 18 at a speed that is substantially similar to the speed of the vehicle when the cleaning element longitudinal actuator 88 is moved in a direction leading towards the blade rear end 28. Movements towards the blade front end 26 are, for example, faster than those towards the blade rear end 28 so as to minimize the time during which the cleaning element 86 does not push the earth 12 in the blade 18. In other embodiments, the link is provided by the controller 100 that controls both the blade depth control wheel and cleaning element longitudinal actuators 72 and 88. Typically, the cleaning element longitudinal actuator 88 is moved in a reciprocating cycle between the blade front and rear ends 26 and 28 without significant pauses.

In use, the ditch digger 10 is attached to the vehicle using the attachment 46. Then, the first element linking arm attachment actuator 45, attachment actuator 49, laterally opposed hydraulic cylinders 70 and linking arm actuator 87 are actuated so that the ditch digger 10 is moved to a desired attitude and position relative to the vehicle, with the blade 18 oriented at an angle with respect to the ground 14 and the blade front end 26 inserted at a predetermined depth thereinto. Subsequently, the ditch digger 10 is pulled by the vehicle and earth 12 is dug and pushed on the blade 18. The cleaning element 86 is simultaneously moved in a reciprocating movement along the blade 18, as described hereinabove, to move the earth 12 towards the conveyor 22. The conveyor 22 conveys the earth 12 away from the blade 18.

In some embodiments of the invention, the cleaning element transversal actuator 90 is operable to selectively move in a reciprocating movement the cleaning element 86 independently from the cleaning element longitudinal actuator 88. Therefore, the cleaning element 86 is thus moved in the plane defined by the cleaning element 86, similarly to a jack hammer. This movement may help in breaking up hard ground.

Although the present invention has been described hereinabove by way of preferred embodiments thereof, it can be modified, without departing from the spirit and nature of the subject invention as defined in the appended claims.

What is claimed is:

1. A ditch digger for removing earth from the ground to dig a ditch, said ditch digger comprising:

a body;

a substantially elongated blade mounted to said body, said blade defining a blade front end and a substantially longitudinally opposed blade rear end, said blade defining a blade bottom section and a pair of laterally opposed blade side sections extending generally upwardly therefrom; and a blade cleaner for moving said earth along said blade, said blade cleaner including a cleaning element operatively coupled to said body so that at least part of said cleaning element is movable substantially longitudinally relative to said blade, said cleaning element defining a cleaning element upper end and a cleaning element lower end opposed thereto, said cleaning element being movable between an extended configuration and a retracted configuration, said cleaning element lower end being closer to said blade bottom section in said extended configuration than in said retracted configuration; a cleaning element longitudinal actuator operatively coupled to said cleaning element for moving said at least part of said cleaning element substantially longitudinally along said blade; and a cleaning element transversal actuator operatively coupled to said cleaning element for moving said cleaning element between said retracted and extended configurations;

wherein, when said ditch digger is in an operational configuration, said blade bottom section is lower adjacent said blade front end than adjacent said blade rear end;

whereby moving said ditch digger along said ground with said blade front end inserted in said ground and said blade rear end provided above said ground removes said earth from said ground to dig said ditch.

2. A ditch digger as defined in claim 1, wherein said cleaning element longitudinal and transversal actuators are operatively coupled to each other such that:

when said cleaning element moves in a frontward direction leading from said blade rear end towards said blade front end, said cleaning element is in said retracted configuration; and when said cleaning element moves in a rearward direction leading from said blade front end towards said blade rear end, said cleaning element is in said extended configuration.

3. A ditch digger as defined in claim 1, wherein said cleaning element includes a fork-shaped member.

4. A ditch digger as defined in claim 1, further comprising a cleaning element support provided above said blade, said cleaning element being pivotally mounted to said cleaning element support such that said cleaning element lower end moves substantially longitudinally relative to said blade when said cleaning element is pivoted relative to said cleaning element support.

5. A ditch digger as defined in claim 1, further comprising a blade depth control wheel mounted to said body substantially adjacent and substantially above said blade front end and a blade depth control wheel actuator for rotating said blade depth control wheel to assist in moving said ditch digger along said ground, said blade depth control wheel and cleaning element longitudinal actuators being operatively coupled to each other such that a wheel speed of said depth control wheel relative to said ground is substantially similar to a cleaning element rearward speed of said cleaning element lower end relative to said blade bottom section.

6. A ditch digger as defined in claim 1, wherein said cleaning element transversal actuator is operable to selectively move in a reciprocating movement said cleaning element independently from said cleaning element longitudinal actuator.

7. A ditch digger as defined in claim 1, further comprising a support wheel mounted to said body to support said body on said ground.

8. A ditch digger as defined in claim 1, further comprising a blade depth control wheel mounted to said body substantially adjacent and substantially above said blade front end.

9. A ditch digger as defined in claim 8, wherein said blade depth control wheel is mounted to said body so as to be movable relative to said blade bottom section to selectively vary a vertical distance between said blade depth control wheel and said blade bottom section.

10. A ditch digger as defined in claim 9, further comprising a blade depth control wheel actuator for rotating said blade depth control wheel to assist in moving said ditch digger along said ground.

11. A ditch digger as defined in claim 1, further comprising a conveyor provided adjacent said blade rear end for conveying said earth away from said blade, said conveyor extending in a direction leading away from said blade.

12. A ditch digger as defined in claim 1, wherein said blade has a substantially arcuate transversal cross-sectional configuration.

13. A ditch digger as defined in claim 1, wherein said blade is substantially hemi-cylindrical.

14. A ditch digger as defined in claim 1, wherein said body includes a body first element attachable to a vehicle, a body second element supporting said blade and a linking arm extending between said body first and second elements.

15. A ditch digger as defined in claim 14, wherein said linking arm is pivotally mounted to both said body first and second elements.

16. A ditch digger as defined in claim 15, wherein said body second element is laterally offset relative to said body first element.

17. A ditch digger as defined in claim 15, further comprising a linking arm actuator operatively coupled to at least one of said body first and second elements and to said linking arm for selectively adjusting an angle between said at least one of said body first and second elements and said linking arm.

* * * * *